US005615436A

United States Patent [19]

Brown

[11] Patent Number: 5,615,436

[45] Date of Patent: Apr. 1, 1997

[54] SUSPENSION BRIDGE FRAMEWORK

[75] Inventor: William Brown, London, Great Britain

[73] Assignee: Stretto Di Messina S.P.A., Rome, Italy

[21] Appl. No.: 428,135

[22] PCT Filed: Oct. 27, 1993

[86] PCT No.: PCT/EP93/02985

§ 371 Date: May 26, 1995

§ 102(e) Date: May 26, 1995

[87] PCT Pub. No.: WO94/10386

PCT Pub. Date: May 11, 1994

[30] Foreign Application Priority Data

Oct. 28, 1992 [IT] Italy ..... MI92A2466

[51] Int. Cl.[6] ..... E01D 11/00

[52] U.S. Cl. ..... 14/18; 14/73

[58] Field of Search ..... 14/18, 19, 20, 14/21, 22, 69.5, 73, 78

[56] References Cited

U.S. PATENT DOCUMENTS 3,132,363 5/1961 Roberts ..... 14/18

4,741,063 5/1988 Diana ..... 14/18

*Primary Examiner*—Denise L. Ferensic
*Assistant Examiner*—Pamela A. O'Connor
*Attorney, Agent, or Firm*—Young & Thompson

[57] ABSTRACT

Framework for a suspension bridge of the type comprising an essentially flat main structure, the top surface of which forms the traffic lane for the transport structure crossing the bridge, anchored to a suspension system formed of a plurality of vertical hangers (6) fixed to catenary cables (5) anchored to end piers of the bridge. The framework consists of at least two parallel longitudinal box-like bodies corresponding to two runways of the bridge, reciprocally spaced by an extent equal to their transverse dimension. Said bodies have a cross section with a profile adapted to favor the proper flow of the wind stream and they are interconnected, at regular intervals, by stiff supporting transverse ledgers (4) having in turn a box-like configuration and carrying at their ends means for their anchorage to the suspension hangers (6).

10 Claims, 3 Drawing Sheets

SUSPENSION BRIDGE FRAMEWORK

FIELD OF THE INVENTION

The present invention concerns suspension bridges comprising an essentially flat main structure, or framework, the top surface of which forms the roadway for the transport means crossing the bridge, and a suspension system formed of catenary cables anchored to end piers of the bridge and of a plurality of vertical stays or hangers to suspend the bridge framework to the catenary cables.

BACKGROUND OF THE INVENTION

It is known that, when planning suspension bridges one must forcedly take into account the action of the wind, which not only involves a substantially static cross-wind pressure, but also vibrations. Two distinct planning theories are followed at present:

on the one hand, according to a more ancient technique, the bridge framework is formed of a trestle structure which is particularly rigid and of considerable height compared to the width of the bridge; this type of structure opposes an essentially static resistance to the aerodynamic wind forces;

on the other hand, according to a more modern technique, the bridge framework is formed of a more slender and thus more flexible structure, which is however adapted to oppose an essentially dynamic resistance to the action of the wind.

As known, these suspension bridges have vibration frequencies of their own; normally, with no wind, the basic flexural vibration frequency differs from the basic torsional vibration frequency, both being generally very low. Nevertheless, the action of side winds varies said typical vibration frequencies, particularly because—especially in bridges with large transversal dimensions and/or a wide span, for instance motorway bridges—the flat suspended structure behaves, when actually exposed to side winds, similarly to a wing surface, hence with a "lifting" effect which greatly varies from one moment to the next.

As wind increases its force, the two aforespecified vibration frequencies tend to approach, up to the point of coinciding: in these circumstances, the structure is thus subjected to so-called "flutter" conditions, i.e. to flexural-torsional stresses which may even be dangerous for the stability of the whole bridge framework.

A suspension bridge of this second type—and the problems connected therewith, particularly those concerning the flutter phenomena—is described in EP-A-0.233.528, filed by the same Applicant, to which reference is made for a better understanding of the present invention.

The main object of EP-A-0.233.528 is a wing structure, which is rigidly fixed to the lateral edges of the bridge framework and is meant to increase the flutter speed of the bridge beyond the top speed of the wind expected in the bridge area. Nevertheless, said wing structure is conceived so as to be substantially independent from the framework; in fact, the EP-A-0.233.528 by no means describes said framework.

Studies carried out by the Applicant on these types of suspension bridges, including tests in a wind tunnel, have however proved how also the structure of the framework is of considerable importance for the behaviour of the bridge in strong wind conditions.

OBJECT OF THE INVENTION

The object of the present invention is to therefore propose a suspension bridge framework having an improved dynamic behaviour under the action of the wind.

SUMMARY OF THE INVENTION

This object is reached due to the fact that said framework consists of at least two parallel longitudinal box-like bodies—corresponding to two runways of the bridge—mutually spaced by an extent equal to their transversal dimension, said bodies being interconnected at regular intervals by stiff supporting transversal ledgers and the cross-section of said bodies having a profile adapted to favour the proper flow of the wind stream.

BRIEF DESCRIPTION OF THE DRAWINGS

Further characteristics and advantages of the bridge framework according to the present invention will be more evident from the following detailed description of a preferred embodiment thereof, given by way of example and illustrated on the accompanying drawings, in which.

DETAILED DESCRIPTION OF THE INVENTION

Figure 1:
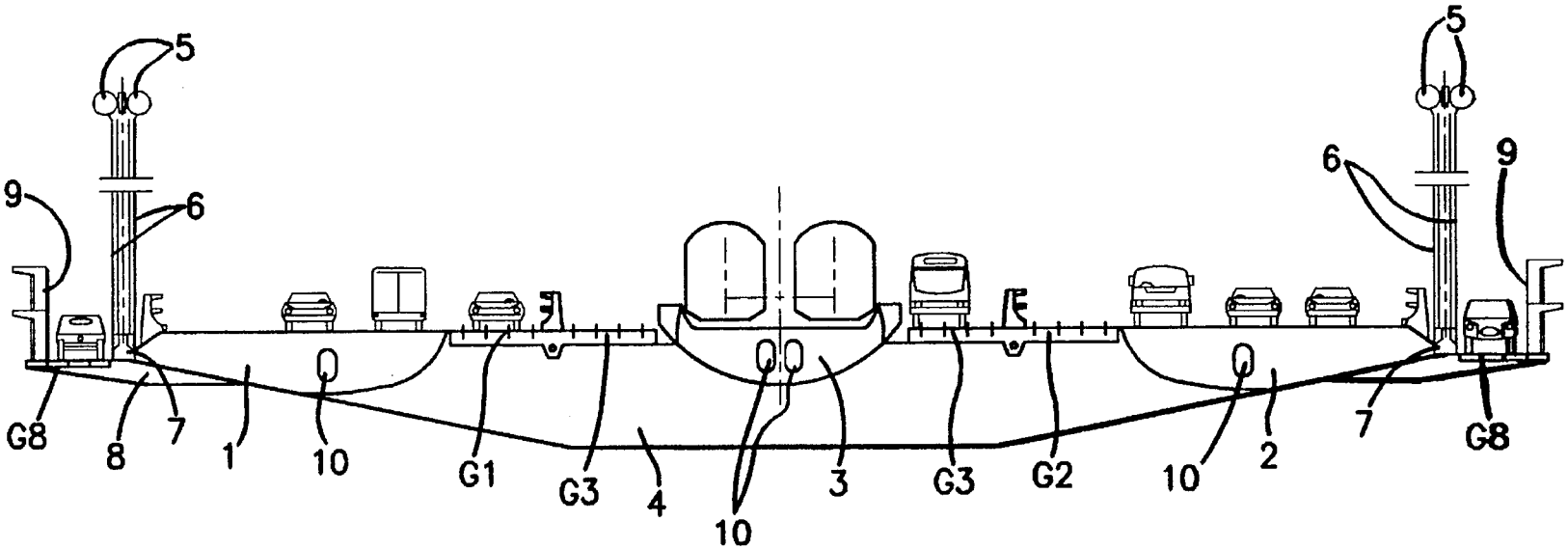
FIG. 1 is a diagrammatic cross-section view of the suspension bridge according to the invention.

The suspension bridge shown in FIG. 1 comprises three runways and, precisely, two lateral runways—each forming a three-lane motor-way—and a central runway for two railway lines.

According to the present invention, each runway is formed by the top surface of a longitudinal box-like body (better described hereinafter) extending throughout the length of the bridge. FIG. 1 shows a cross-section of the bodies 1 and 2, forming the lateral runways, and of the body 3 forming the central runway.

According to a first important characteristic of the invention, these parallel longitudinal box-like bodies are suitably spaced and interconnected by ledgers 4, with an arrangement leaving a free or substantially free space between one body and the next. The transversal dimension of said free space is of the same order of magnitude as the transversal dimension of the bodies forming the runways.

More precisely, the bodies 1 and 2 have a transversal dimension of 12 to 13 m, while the central body 3 has a transversal dimension of 8 to 10 m, and the free spaces between said bodies have a transversal dimension of about 8 m. The ledgers 4, which are consequently about 50 m long, are positioned transversally to the bridge—along its full length—at regular intervals of about 30 m.

The bodies 1, 2, 3, and the ledgers 4, form the framework of the bridge, which is suspended from catenary cables 5 through a plurality of hangers 6. According to another important characteristic of the invention, the hangers 6 are anchored to said framework only in correspondence of the ledgers 4, onto anchor plates 7 fixed to the ends of said ledgers.

To the ends of the Ledgers 4 there are also fixed arms 8, outwardly projecting—beyond the hangers 6—by an extent of 3 to 4 m; said arms 8 support at their free ends a windbreak barrier 9, of the type of that forming the object of U.S. patent application Ser. No. 428,085, filed Jul. 3, 1995.

In correspondence of the free spaces between each longitudinal box-like body, as well as on the outwardly projecting arms 8, there are positioned gratings G, which have a transparency (ratio between mesh-holes surface and overall surface) of the order of 70%, and which are therefore adapted to form safety runways, while allowing a substantially free passage of the wind stream.

Said gratings are moreover sufficiently stout to be used as service ways, also practicable by motor vehicles. In the illustrated embodiment, the gratings G1 and G2 can be used as emergency lanes for road traffic, while the gratings G3 can be used as service lanes for railway traffic and the gratings G8 can be used as service lanes for bridge maintenance.

Figure 4:
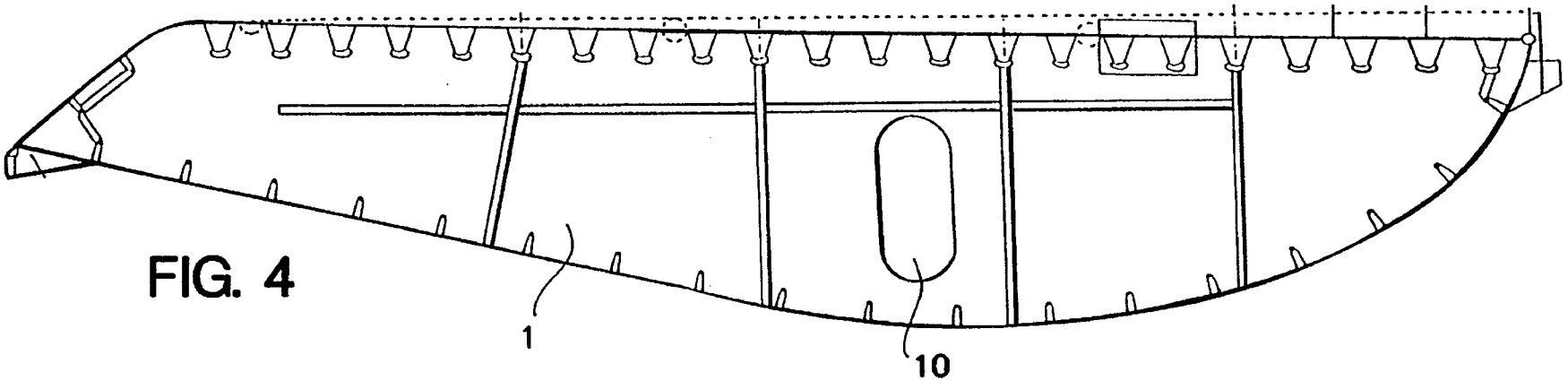
FIGS. 4 and 5 are cross-section views, on an enlarged scale, of a lateral body of the bridge forming the runway for road traffic and, respectively, of a central body of the bridge forming the runway for railway traffic.
Figure 5:
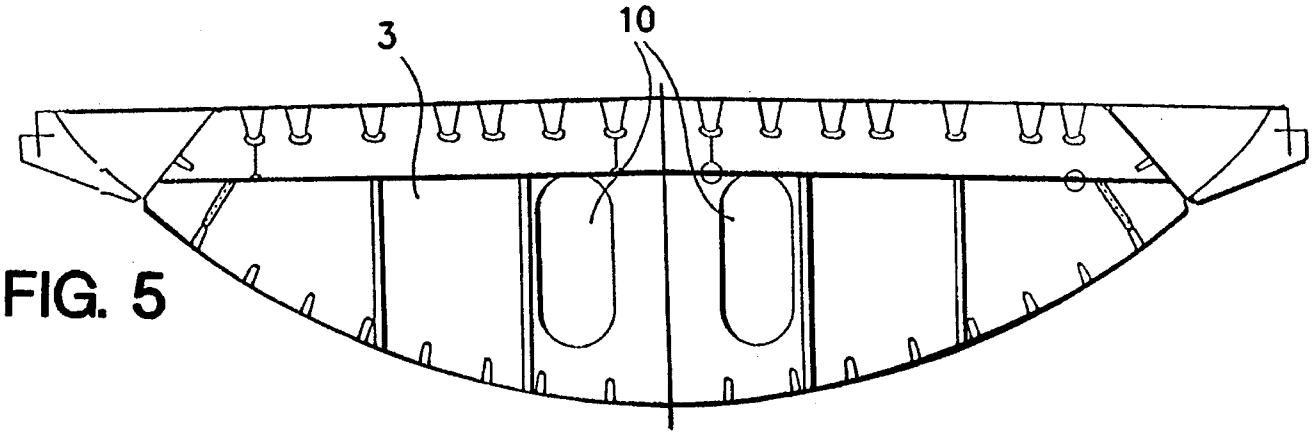

According to the fundamental characteristic of the present invention, the bodies 1, 2 and 3—the top surface of which must be perfectly flat—have their bottom surface profiled (see, in particular, FIGS. 4 and 5) in such a way as to favour a pre-established correct flow of the wind stream.

Said correct flow is also favoured by the free spaces provided between each box-like body, since the gratings G1, G2 and G3 are—as said—substantially open to the wind stream.

Figure 3:
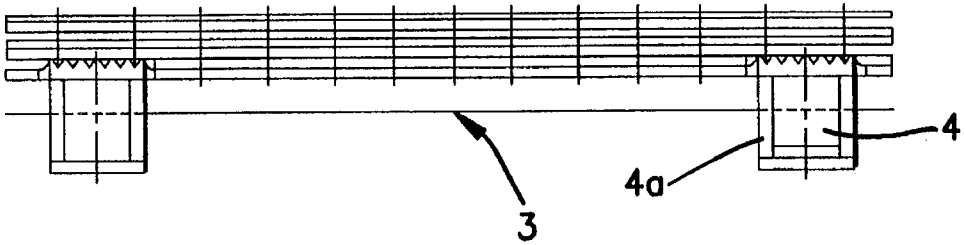
FIG. 3 is a diagrammatic cross-section view along the line III—III of FIG. 2.
Figure 2:
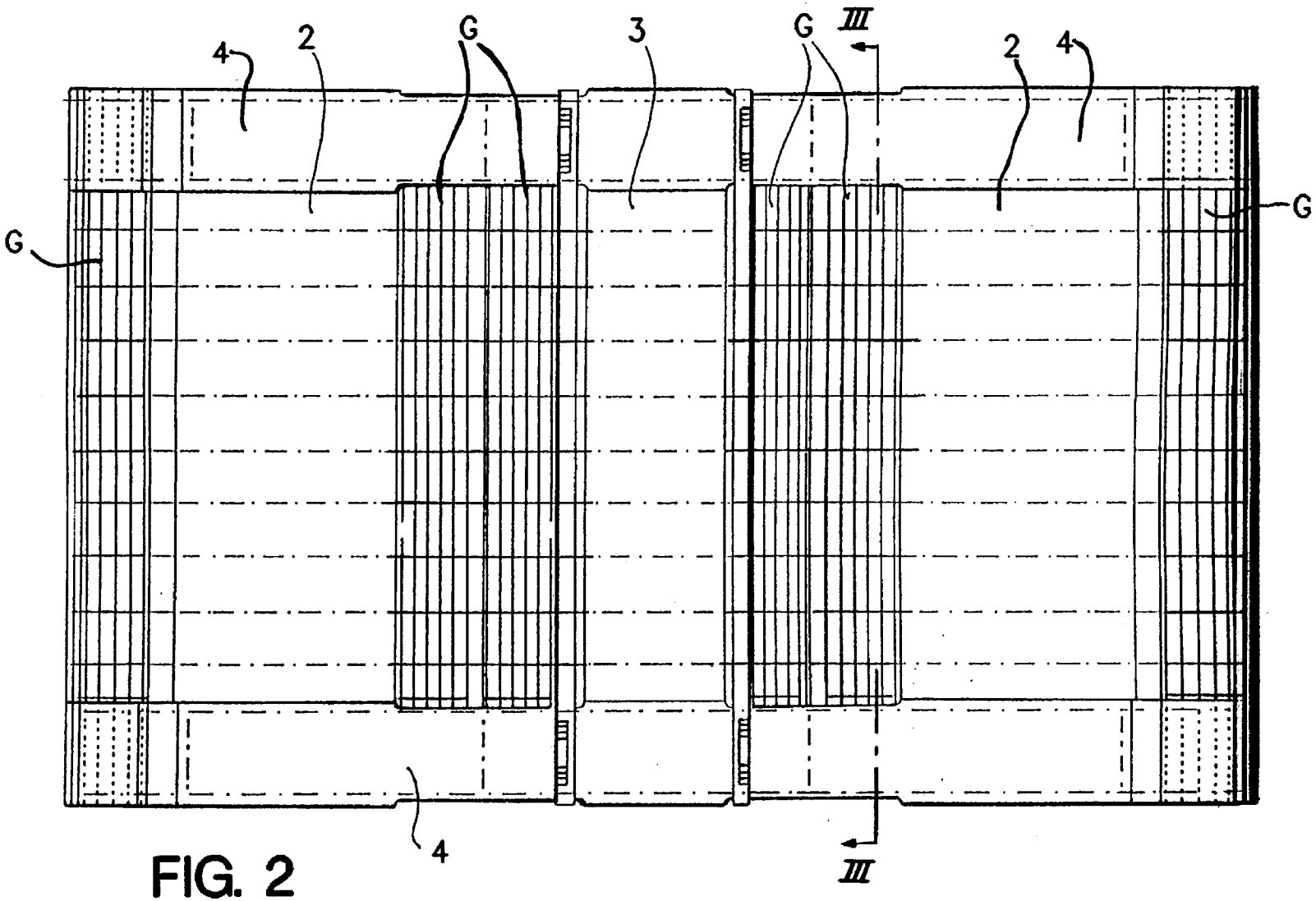
FIG. 2 is a diagrammatic plan view of a bridge section included between two successive ledgers.

Also the transversal ledgers 4 have a box-like configuration (see FIG. 3) and their dimensions—like those of the bodies 1, 2 and 3—are such that, according to a still further important characteristic of the invention, they can all be crossed by a standing person, and thus be perfectly inspected throughout the bridge length.

Some manholes 10 (FIGS. 1, 4, 5) are formed in the vertical walls 4*a* of the ledgers 4, into which engage the longitudinal box-like bodies, to allow people to pass from the ledgers into either of the adjacent box-like bodies; in this way, the whole internal part of the bridge framework—formed of box-like elements—can be crossed uninterruptedly, without ever having to go up on the traffic lanes.

It is be understood that the invention is not limited to the particular embodiment described heretofore, which is only a non-limiting example of its scope, but that many other embodiments are possible—especially as concerns the profile and number of the longitudinal box-like bodies, according to traffic requirements on the bridge—all within reach of a technician skilled in the art, and all thus falling within the protection field of the present invention.

I claim:

1. A suspension bridge having a framework comprising a substantially flat main structure, said main structure having a top surface which forms a traffic flow lane, a suspension system formed by a plurality of vertical stays or hangers (6) fixed to catenary cables (5) anchored to end piers of the bridge, said framework being anchored to said suspension system, said framework comprising a plurality of parallel box bodies extending longitudinally of the bridge and corresponding to two runways of the bridge, said box bodies being spaced apart a distance equal to their transverse dimension, and stiff supporting transverse ledgers (4) by which said box bodies are interconnected at regular intervals, said box bodies having a transverse cross section which is an aerodynamic profile.

2. A suspension bridge as claimed in claim 1, wherein said longitudinal box bodies have upper surfaces that are flat and under surfaces that are curved with a profile to favor flow of a wind stream.

3. A suspension bridge as claimed in claim 1, wherein securement of the framework to suspension hangers (6) is provided only at the ends of said ledgers.

4. A suspension bridge as claimed in claim 1, having thereon gratings forming safety runways positioned in free spaces between the longitudinal box bodies.

5. A suspension bridge a claimed in claim 4, wherein said gratings have a transparency of the order of 70% so as to let through a wind stream.

6. A suspension bridge as claimed in claim 1, wherein said longitudinal box bodies have dimensions to accommodate people along their length.

7. A suspension bridge as claimed in claim 1, wherein said ledgers have a box configuration.

8. A suspension bridge as claimed in claim 7, wherein said ledgers have dimensions to accommodate people along their length.

9. A suspension bridge as claimed in claim 1, wherein said longitudinal box bodies engage in vertical walls of said ledgers, manholes being provided in said walls to allow people to pass from said bodies into the ledgers and vice versa.

10. A suspension bridge as claimed in claim 1, comprising three parallel longitudinal box bodies, a central body carrying railway lines, and two lateral bodies carrying roadway traffic.

* * * * *